United States Patent [19]

Hume

[11] 4,414,930

[45] Nov. 15, 1983

[54] KINETIC ENGINE CONTROL

[76] Inventor: Douglas W. Hume, Crane Neck St., W. Newbury, Mass. 01985

[21] Appl. No.: 307,721

[22] Filed: Oct. 2, 1981

[51] Int. Cl.[3] ..... F02B 75/04

[52] U.S. Cl. ..... 123/78 E; 123/197 AB; 188/272

[58] Field of Search ..... 123/197 R, 197 AB, 197 AC, 123/197 A, 78 R, 78 A, 78 E; 188/272

[56] References Cited

U.S. PATENT DOCUMENTS

| | | | |
|---|---|---|---|
| 1,197,591 | 9/1916 | Bargery | 123/58 C |
| 1,747,091 | 2/1930 | Trbojevich | 123/78 E |
| 1,835,096 | 12/1931 | Schwarz | 123/78 E |
| 3,945,358 | 3/1976 | Collins | 123/56 AA |
| 4,054,115 | 10/1977 | V. Habsburg-Lothringen | 123/193 |
| 4,254,743 | 3/1981 | Reid et al. | 123/48 B |

FOREIGN PATENT DOCUMENTS

| | | | |
|---|---|---|---|
| 327140 | 6/1903 | France | 123/78 E |
| 936514 | 7/1948 | France | 123/56 AB |
| 471793 | 5/1952 | Italy | 123/197 AB |
| 1216466 | 12/1970 | United Kingdom . | |

*Primary Examiner*—Craig R. Feinberg
*Attorney, Agent, or Firm*—Kenway & Jenney

[57] ABSTRACT

An internal combustion engine in which the displacement in the cylinders is automatically varied to match the power output of the engine to power requirements. One or more kinetic controllers external to the cylinders connect engine piston cross-shafts to the engine crankshaft. Each kinetic controller is capable of changing its length through the use of damped elastic components. At high RPM the engine intake and power strokes are lengthened relative to that at low RPM as controller length increases. Also at high RPM, the engine compression stroke is lengthened as controller length decreases. Thus, at higher engine RPM, greater fuel charge, higher compression, and greter power are obtained than at lower engine RPM.

4 Claims, 5 Drawing Figures

KINETIC ENGINE CONTROL

BACKGROUND OF THE INVENTION

This invention relates in general to power transfer systems and more particularly the increase of power in such systems by automatically varying cylinder displacement and increasing average piston velocity.

Although the invention has applications to various machines which employ pistons reciprocable in cylinders, such as air compressors, pumps, refrigeration, air conditioning compressors and steam engines, its primary benefits relate to internal combustion engines where the greatest opportunities for conservation of energy are to be found.

The efficiency of internal combustion engines is notoriously low. Moreover, it is not usually possible to match the output of the engine to the demands placed upon it. Obviously, the power required for cruising at speeds of the order of 55 mph is relatively low as compared to the requirements for rapid acceleration. An engine designed for high-acceleration performance has low efficiency not only at cruising speeds but also at lower speeds, because the volume of the cylinder remains constant as do fueling requirements. This fact remains true whether the engine is of the Otto, diesel, or intermediate cycle.

Some attempts have been made to match internal combustion engines to the instantaneous requirements. Relatively recently, there has been developed an automotive engine which automatically selects only as many cylinders, say from 4 to 8, in accordance with the need. A similar approach has been taken on compressors in the past, and some success has been achieved, but drawbacks even in commercial engines of this type remain. By reducing the number of cylinders in use, some reduction of total volumetric displacement was of course accomplished. Nevertheless, the weight of the large engine remains even though less power is delivered when less power is needed.

Another approach to the reduction of volumetric displacement in internal combustion engines is shown in the relatively old U.S. Pat. No. 1,747,091, which issued to N. Trbojevich in 1930. In the patented design, an extensible connecting rod was used between each piston and the crankshaft of the engine. It was claimed that such extensible connecting rods permitted the use of higher combustion ratios and minimized predetonation because of the resilience of the connecting rods. The patented design has never been widely adopted apparently for several reasons. The extensible connecting rod mounted as it was conventionally within the engine was exposed to extremes of temperature and pressure as well as the often corrosive internal environment of the engine, with the result that the life of the mechanism was very short. Also, the fact that the piston is driven toward the crankshaft leads to various mechanical problems, room in the connecting rod area being very limited, close tolerances and linear alignment being necessary and high inertial forces tending to cause the extensible rod to distort and bind, leading to early fatigue.

It is an object of the present invention to vary the displacement of an engine in such a way as to transfer power efficiently.

It is a further object of the present invention to increase the efficiency of an internal combustion engine in terms of fuel consumption.

It is another object to increase engine output power by increasing average piston velocity.

It is a further object of the present invention to prevent excessive shock and stress loads on bearings and associated elements of internal combustion engines.

SUMMARY OF THE INVENTION

Unlike the conventional internal combustion engine, the piston of this invention is not solidly and rigidly connected to the crankshaft. This engine possesses a piston or pistons which are connected to the flywheel through one or more extensible connectors and the crankshaft. The extensible connector link utilizes elastic type material which yields through compression and expansion within predetermined limits. This permits the piston to be somewhat unrestricted during its initial phase of the power stroke.

This relative freedom of movement of the piston is in a linear direction and the piston is allowed to travel a predetermined direction caused by certain pressures applied on it during short intervals of time, without causing substantial rotative motion of the crankshaft.

At the time of initiation of the combustion cycle, the piston is approximately at top dead center and the flywheel is approximately at 0°. Combustion of the fuel then applies an approximately equal pressure throughout the combustion chamber. The piston, being attached to the crankshaft by the extensible links, is thereby not totally influenced by the resistive rotative inertia motion of the flywheel through the crankshaft and the piston is thus permitted to accelerate more readily.

In the structure in which two kinetic controllers are used rather than a single controller, each engine cylinder is slotted at diametrically opposite areas and cross-shafts connected to the piston extend through and reciprocate in those slots as the piston reciprocates. Exteriorly of the cylinder, a kinetic controller connects each end of each cross-shaft to the crankshaft.

Each kinetic controller comprises a cylinder having an end wall connected to a part of the crankshaft. Within each controller cylinder a piston is spring-loaded and damped for limited reciprocation. Each controller piston has a piston rod extending through a bore in the opposite end wall and connected to the engine cross-shaft.

The kinetic controllers permit limited compression or shortening of the connection between engine piston and crankshaft on the compression stroke of the piston and also permit limited extension or lengthening of the connection between engine piston and crankshaft during the intake and power strokes of the piston.

For a better understanding of the present invention together with other features, objects and advantages, reference should be made to the following description of a preferred embodiment which should be read in conjunction with the appended drawing in which:

DESCRIPTION OF PREFERRED EMBODIMENT

Figure 1:
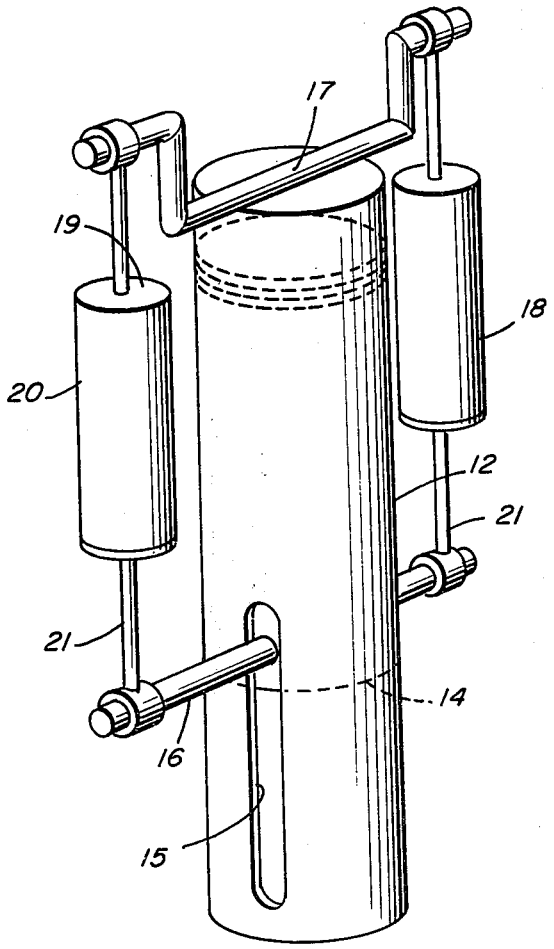
FIG. 1 is a schematic view in perspective of a cylinder of an internal combustion engine incorporating an embodiment of the present invention.

To provide an overall indication of the departure of the present invention from conventional structures, an idealized and fragmentary perspective view of one embodiment of the present invention is shown in FIG. 1. The view is of a single cylinder 12 of an internal combustion engine, a piston 14 being reciprocable in that cylinder. Unlike engines of the prior art, no conventional connecting rods are employed within the cylinder. Rather, the cylinder is slotted as at 15 to permit connection of the piston to a single controller (as described below) or is slotted at 15 and also in an area diametrically opposite the slot 15 (not visible in this view), the slots accommodating a piston cross-shaft 16. The cross-shaft 16 is fixed to and preferably passes through the skirt of the piston 14 at opposite points.

A crankshaft 17 is shown fragmentarily adjacent the cylinder head and it is interconnected to the piston cross-shaft 16 by cylindrical combustion kinetic control units 18 and 20. As is shown and described in greater detail below, each combustion kinetic controller includes a cylinder having an end wall as at 19 connected to an end of the crankshaft 17. Each also contains a piston mounted for limited reciprocation and a piston rod at at 21 passing through the opposite end wall and connected to the cross-shaft 16. Greater detail on the power transfer mechanism is shown in FIGS. 2–5 which illustrate conditions in the engine during the strokes of the piston.

Figure 2:
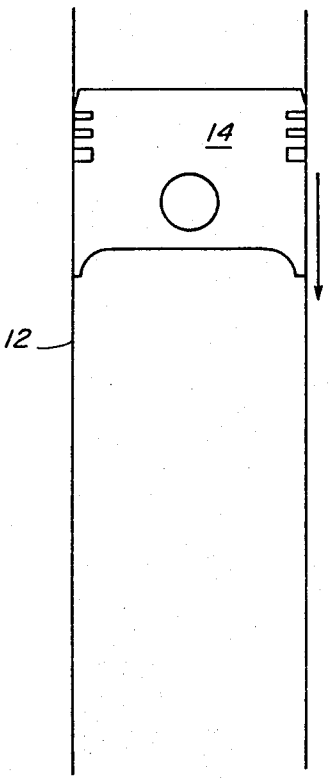
FIG. 2 is a schematic view of a portion of an engine in which the invention is incorporated as seen during the intake stroke.

In FIG. 2, the piston 14 is shown adjacent the top of the cylinder 12 at a nominal top dead center (TDC) position. The intake stroke commences when the intake valve opens and the piston then moves from the TDC position of FIG. 2 to the bottom dead center (BDC) position shown in FIG. 3 at BDC-A. This is the bottom dead center position which the piston will reach when the engine is running at low RPM. As the RPM of the engine increase, the inertia of the piston 14 also increases, causing the kinetic control units to extend. At maximum high RPM, the piston reaches the position BDC-B. As a result of the increased travel of the piston which takes place as RPM increases, larger amounts of the air-fuel mixture are drawn into the cylinder through the intake valve.

Figure 4:
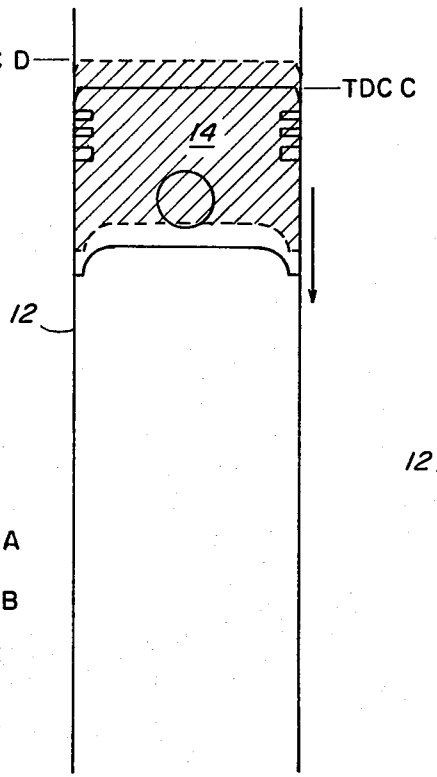
FIG. 4 is a schematic view of a portion of an engine in which the invention is incorporated as seen during the power stroke.
Figure 3:
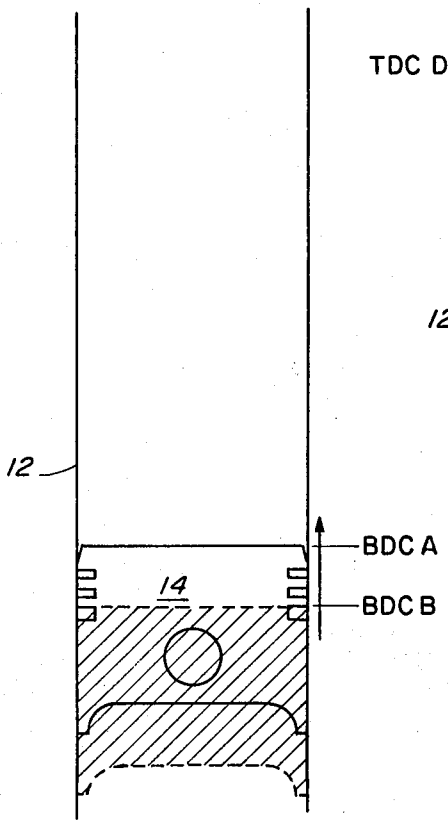
FIG. 3 is a schematic view of a portion of an engine in which the invention is incorporated as seen during the compression stroke.

In FIG. 3, the initiation of the compression stroke is indicated. Both intake and exhaust valves are closed and the piston moves from BDC to TDC. As shown in FIG. 4, at low engine RPM, the piston reaches the position TDC-C. At high RPM, the increased inertia of the piston causes compression or shortening of the kinetic controllers and the piston reaches the position TDC-D. Under such circumstances, the pressure of the air-fuel mixture is increased because of the decreased volume between the piston and the cylinder head.

Figure 5:
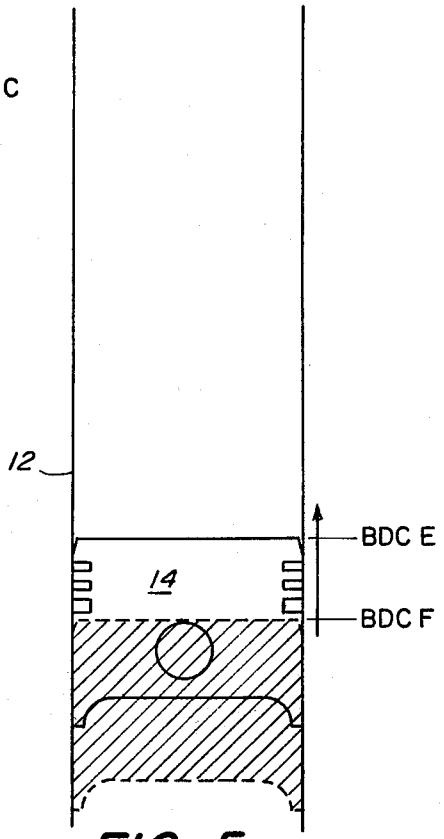
FIG. 5 is a schematic view of a portion of an engine in which the invention is incorporated as seen during the exhaust stroke.

FIG. 4 also indicates the initiation of the power stroke. At this point, both intake and exhaust valves are closed and ignition of the gases occurs. The burning gases force the piston from the top dead center (TDC) position somewhat ahead of, and out of phase with, the crankshaft to a bottom dead center (BDC) position as shown in FIG. 5. At low RPM, the piston assumes the position BDC-E. At high RPM, the force of combustion drives the piston to the lower position BDC-F, the kinetic controllers lengthening to permit the increased travel. The increased stroke allows more work to be derived from the power stroke as the piston average velocity is increased.

In FIG. 5, the initiation of the exhaust stroke is illustrated. Only the exhaust valve is open, and the piston moves from BDC to TDC, driving burned gases from the cylinder and reaching a position for the initiation of a new cycle, the effect of operation at low or high RPM being of minor consequence at this point in the cycle.

Figure 6:
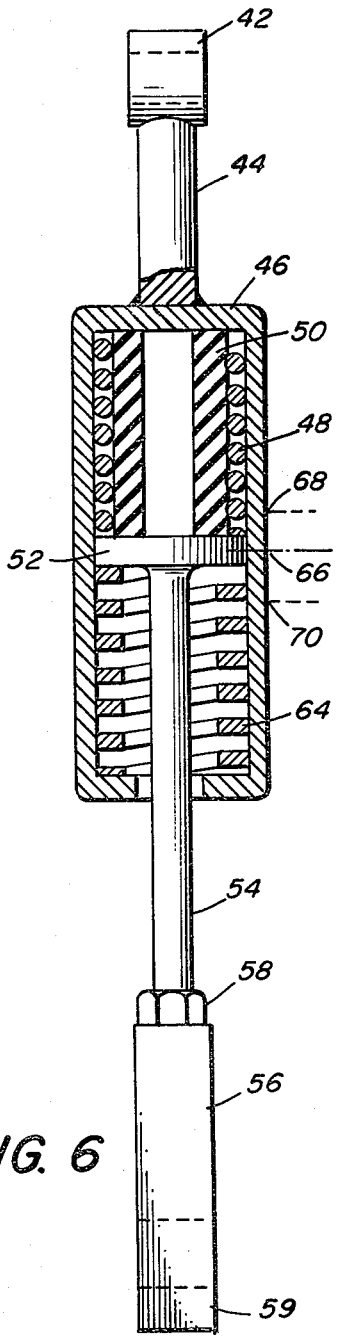
FIG. 6 is a detailed view of a preferred combustion kinetic controller.

A specific example of the combustion kinetic controller is shown in FIG. 6. A journal 42 having a suitable internal bearing surface is welded or otherwise solidly connected to a shaft 44 which in turn is welded to the end wall of a controller cylinder 46. The journal 42 is designed to fit upon the engine crankshaft. Within the controller cylinder 46 is an upper helical spring 48 which is fitted between the inside wall of the controller cylinder 46 and a resilient interference damping sleeve 50. Immediately beneath the upper spring 48 and the resilient damper 50 is a controller piston 52 slidably mounted within the controller cylinder 46. A piston rod 54 carries an adjusting nut 58 threadably connected to it, the adjusting nut bearing upon the top surface of the bearing block 56. At the lower end of the bearing block 56, a journal 59 having a suitable internal bearing surface is designed to fit upon an end of a cross-shaft.

A lower spring 64 is disposed between the piston 52 and the bottom inner wall of the controller cylinder 46.

In operation, the upper spring allows a limited compression or shortening of the controllers on the compression stroke of the engine. During the intake and power strokes, the lower spring allows a somewhat greater extension of the controllers. At the point 66, the equilibrium position of the mid-plane of the piston is indicated. At 68, the upper position of the piston is shown, that being the position which the piston assumes when the controller unit is compressed. At the point 70, the position of the piston 52 is shown when the kinetic controller is extended on the intake and power strokes. The greater extension relative to shortening of the controller units may be seen.

Reverting to FIG. 1, in the present invention, as explosive energy of combustion develops, the piston 14 offers less resistance to the combustion impact than that of a conventional piston solidly connected to the crankshaft. This is due to the extensibility or lengthening of the combustion kinetic controller units 18 and 20 which link the engine piston to the crankshaft disposed above the cylinder head.

In operation, compression of the relatively light upper spring 48 allows a limited compression or shortening of the controllers on the compression stroke (FIGS. 3–4) of the engine. This permits the engine piston 14 to approach more closely the internal cylinder head and this decreased volume causes higher compression of the air-fuel mixture. The resilient damping sleeve 50 is also being subjected to compression by the piston 52 and it expands radially until its outer diameter fills the openings between turns of the inner diameter of the spring 48. Further axial compression of the damper 50 is not possible because all the volume normally existing between the outer diameter of the damper 50 and the inner diameter of the spring 48 is filled. Further shortening of the controller ceases and upward travel of the engine piston 14 is likewise halted.

During the power stroke (FIGS. 4–5), the forces of combustion and momentum cause the relatively heavy spring 64 to be compressed by the controller piston 52 as that piston is pulled down by the downward travel of the engine piston 14. The relatively light spring 48 initially expands as the controller piston 52 moves downwardly. Compression of the spring 64 is very rapid at first in response to combustion forces, but as the engine piston approaches bottom dead center, the spring 64 begins to return to its original axial length. At the same time, the spring 48 ceases its axial expansion, partly because its inside diameter contracts as it expands and the outer diameter of the resilient sleeve 50 limits the amount by which the inside diameter of the spring 48 can contract. In its relaxed state, the controller and its components are of such dimensions that there is an interference fit between the inside diameter of the spring 48 and the outside diameter of the sleeve 50.

The action of the kinetic controllers may alternatively be explained as follows. When the kinetic controllers 18 and 22 are experiencing tensile forces, as in the combustion and intake strokes, the controller piston 52 will pass from or through its equilibrium position 66 (FIG. 6), resulting in the compression of the spring 64. As each kinetic controller continues to elongate, the spring 64 becomes progressively more compressed, building up resistance linearly proportional to the amount of compression. For all practical purposes, the maximum extended position of the kinetic controllers is when the coils in the spring 64 are completely collapsed. As the spring 64 is compressed, the spring 48, on the other side of the piston 52, elongates an equal amount. The resilient damper 50 will also undergo elongation, but not necessarily equal to that of the spring 48, since the amount it is initially compressed may be less than the travel of the piston 52 from the equilibrium position 66.

When operating conditions are such that kinetic controllers 18 and 20 are being compressed in length beyond the position 66, the spring 48-damper 50 combination performs in a unique manner. As the spring 48 compresses, its outside diameter will increase and be limited to the inside diameter of the kinetic controller. The damper 50 will likewise expand in diameter, but in such a manner that it loses its cylindricity as the compression increases. Its outer surface will be deformed into and between the coils of the spring 48; this adds synergistically and progressively to the increased resistance offered by each element to the compressive movements from the piston 52. Such interaction results in increased damping over that of the internal damping of the damper 50 alone, because of the relative movements of contiguous surfaces. As the compression of the spring 48 progresses, the void space in the volume of the kinetic controller containing the spring 48 and the damper 50 diminishes; under certain conditions, to an extent where no free space exists. When no free space exists, further compression of the spring 48 and the damper 50 would be governed by their bulk moduli, which are relatively very high. Thus, for all practical purposes, the kinetic controllers would be at their shortest operating length. This length, of course, is carefully chosen relative to engine cylinder height dimensions to prevent the piston 14 from approaching too closely to the cylinder head.

In conventional internal combustion engines, combustion takes place as the piston is approaching, or at, TDC. All internal cylinder surfaces are exposed to sudden high temperature/high pressure effects. These effects are distributed equally in a fraction of a second throughout the cylinder volume. In other words, a high-velocity expansion impact occurs against the cylinder head, the cylinder walls and the top of the piston. These effects develop far more quickly than any downward movement of the piston can take place. Some energy of the high-velocity rapid expansion is indeed consumed in attempting to move the piston, but much energy is also absorbed by all other internal cylinder surfaces. Because these other surfaces are immovable, the energy is converted into heat which is subsequently lost or wasted.

As is plain from the drawing and description, having the combustion kinetic control units external to the engine permits a wide range of physical dimensions and of structural materials to be employed.

Suitable dimensions for controller cylinders, pistons, springs and damper for an engine having a piston 3 inches in diameter and a stroke of 3 inches are as follows:

| EXTENSIBLE UNITS | |
|---|---|
| Overall shaft-to-shaft length | 19¾" C to C |
| Cylinder 46 length | 7⅝" |
| Cylinder 46 outside diameter | 2¼" |
| Cylinder 46 inside diameter | 2" |
| Piston 52 outside diameter | 2" |
| Piston Rod 54 outside diameter | ⅝" |
| Top Spring 48 free length | 5¾" |
| Top Spring 48 wire size | 3/16" |
| Top Spring 48 outside diameter | 1.965" |
| Top Spring 48 inside diameter | 1.590" |
| Bottom Spring 64 free length | 3" |
| Bottom Spring 64 wire size | 3/16" × ⅜" |
| Bottom Spring 64 outside diameter | 1.965" |
| Bottom Spring 64 inside diameter | 1.210" |
| Resilient Damper 50 free length | 3" |
| Resilient Damper 50 outside diameter | 1.640" |
| Resilient Damper 50 inside diameter | ½" |

Compressibility of springs is as follows:

TOP SPRING 48 CONSTANT:

26.6# per inch (Spring will compress 1" if 26.6# is applied on it)

BOTTOM SPRING 64 CONSTANT:

1,500# per inch (Spring will compress 1" if 1,500# is applied on it)

With the typical engine piston described (3" diameter—3" stroke) and the above spring constants, piston travel as in FIG. 3 may vary from BDC-A to BDC-B over a range of about ½" to 1¼". The variation as in FIG. 4 from TDC-C to TDC-D is from ⅛" to ¼".

Preferred materials for the controller unit are brass for the cylinder 46, the piston 52 and the piston shaft 54; and polyurethane for the damper 50, a specifically useful polyurethane being Flexane 60 manufactured by the Devcon Co. Because the units are not exposed to the internal heat, pressure, lubricants and corrosive combustion products as in the case of springs and the like mounted internally in the engine, they are relatively long-lived and capable of easy servicing and replacement. The units may also be adapted to two-cycle engines with only minor modification.

What is claimed is:

1. Apparatus for transferring power in an internal combustion engine having at least one cylinder, each said cylinder having a head and a piston reciprocable on an axis on one side of said head in said cylinder toward and away from said head, a crankshaft mounted adjacent and external to said head located on a side of said head opposite that of said one side, said cylinder having diametrically oppositely disposed longitudinal slots formed in the walls thereof, a cross-shaft fixed to said piston and extending outwardly through said slots and links of variable length connecting said cross-shaft to said crankshaft, each said link of variable length being extensible to a relatively great extent during the intake and power strokes of said engine and compressible to a relatively short extent during the compression stroke of said engine.

2. Apparatus for transferring power as defined in claim 1, wherein said link of variable length comprises a control cylinder having a closed end wall connected to said crankshaft, a control piston reciprocable in said cylinder, means connecting said control piston to said piston and means for damping and limiting the reciprocable travel of said control piston in said control cylinder.

3. Apparatus as defined in claim 2 wherein said means for damping and limiting the reciprocable travel of said control piston in said control cylinder comprises a relatively compressible first helical spring disposed in said control cylinder between one surface of said control piston and said control cylinder closed end wall, a control piston rod fixed to the opposite surface of said control piston extending through an apertured end of said control cylinder, and forming a part of said means connecting said control piston to said piston, a relatively stiff second helical spring disposed between said opposite surface of said control piston and said apertured end of said control cylinder, and a cylindrical resilient member disposed within said first helical spring having ends in contact with said closed end of said control cylinder and said one surface of said piston.

4. Apparatus as defined in claim 3, wherein said cylindrical resilient member is composed of polyurethane and has an outside diameter sufficiently greater than the inside diameter of said first helical spring whereby there is normally an interference fit between said resilient member and said first helical spring.

* * * * *